US007164101B2

(12) United States Patent
McWilliams

(10) Patent No.: US 7,164,101 B2
(45) Date of Patent: Jan. 16, 2007

(54) ELECTRIC HEATING ASSEMBLY

(75) Inventor: Kevin Ronald McWilliams, Stratford-upon-Avon (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 11/063,052

(22) Filed: Feb. 22, 2005

(65) Prior Publication Data

US 2005/0194375 A1 Sep. 8, 2005

(30) Foreign Application Priority Data

Mar. 2, 2004 (GB) ..... 0404630.6

(51) Int. Cl.
*H05B 3/68* (2006.01)

(52) U.S. Cl. ..... 219/460.1; 219/446.1

(58) Field of Classification Search ..... 219/443.1, 219/445.1, 446.1, 447.1, 448.11, 448.12, 219/448.13, 460.1
See application file for complete search history.

(56) References Cited

U.S. PATENT DOCUMENTS 4,447,710 A * 5/1984 McWilliams ..... 219/448.14
4,816,647 A * 3/1989 Payne ..... 219/448.12
5,261,387 A * 11/1993 Gressenich ..... 126/39 H
5,866,239 A * 2/1999 Shimatani et al. ..... 428/210
6,104,007 A * 8/2000 Lerner ..... 219/445.1

* cited by examiner

*Primary Examiner*—Sang Paik
(74) *Attorney, Agent, or Firm*—Ira S. Dorman

(57) ABSTRACT

An electric heating assembly includes a cooking plate (4) having a lower surface (6) relative to which is supported an electric heater (10) and an upper surface (8) adapted to receive a cooking utensil (12) on a heating zone (14) overlying the electric heater. The electric heater incorporates an electric heating element (22) and a temperature-responsive device (32) adapted to monitor temperature of the cooking utensil through the cooking plate at a predetermined region (34) of the overlying heating zone. The predetermined region is provided with visual identification (44) on the upper surface of the cooking plate for location of the cooking utensil at least partially over the visual identification.

22 Claims, 2 Drawing Sheets

ELECTRIC HEATING ASSEMBLY

This invention relates to an electric heating assembly in which a cooking plate, such as of glass-ceramic material, has a lower surface with at least one electric heater supported in contact therewith. The cooking plate has an upper surface adapted to receive a cooking utensil, such as a pan, on at least one heating zone overlying the heater or heaters. The or each heater incorporates at least one electric heating element.

DESCRIPTION OF PRIOR ART

It is known to provide visual identification of the location of a heating zone on the cooking plate, by means of marking, such as of outline form, provided on the upper surface of the cooking plate. Such marking is known to comprise a printed high-temperature-withstanding enamel, paint or lacquer.

It is also known to provide a temperature-responsive device incorporated in a heater and which is adapted to monitor temperature of the cooking utensil through the cooking plate. Such temperature-responsive device operates in association with electronic circuitry to provide closed loop control of energising of the heating element or elements in the heater to achieve and maintain a selected temperature for the cooking utensil. A system used for operating a heating assembly in this way is commonly referred to as an autocook system.

For accurate and reliable operation of such a system, the temperature-responsive device is required to be supported in good thermal contact with the lower surface of the cooking plate, and preferably at a region of the cooking plate which is screened from direct thermal radiation from the heating element or elements. The temperature-responsive device is typically of capillary, thermocouple or film electrical resistance form and is generally arranged to cover only a small region of the lower surface of the cooking plate. It is also important that the temperature is monitored where there is maximum contact between the cooking utensil and the upper surface of the cooking plate. Since cooking utensils commonly have a concave base, such that optimum contact with the upper surface of the cooking plate is obtained at an outer peripheral region of their base, the temperature-responsive device is generally located underlying the heating zone in a position proximate a peripheral edge of the heating zone. Such an arrangement is fully satisfactory where a cooking utensil is used which substantially fully covers the heating zone. However, when a smaller cooking utensil is used, contact between the base thereof and the region of the cooking plate where the temperature-responsive device is provided, cannot be guaranteed. Although the smaller cooking utensil might be offset on the heating zone by a user in an endeavour to overcome this difficulty, this is impracticable since the actual location of the temperature-responsive device underneath the cooking plate cannot be seen by the user and is unknown.

OBJECT OF THE INVENTION

It is an object of the present invention to overcome or minimise this problem.

SUMMARY OF THE INVENTION

According to the present invention there is provided an electric heating assembly comprising a cooking plate having a lower surface relative to which is supported at least one electric heater and an upper surface adapted to receive a cooking utensil on at least one heating zone overlying the at least one electric heater, the at least one electric heater incorporating at least one electric heating element and a temperature-responsive device adapted to monitor temperature of the cooking utensil through the cooking plate at a predetermined region of the overlying heating zone, the predetermined region being provided with visual identification means on the upper surface of the cooking plate for location of the cooking utensil at least partially thereover.

The cooking plate may comprise glass-ceramic material.

The predetermined region may be proximate an edge of the heating zone with which it is associated.

The visual identification means may comprise marking means applied to the upper surface of the cooking plate. Such marking means may comprise high-temperature-withstanding enamel, paint or lacquer which may be of printed form and may be applied as an outline to the predetermined region and/or as a pattern on the predetermined region and may comprise or include one or more words and/or symbols and/or indicia.

Alternatively, the marking means may comprise one or more scribed, etched or grooved regions of the upper surface of the cooking plate.

The at least one heating zone may be positionally visually identified by further marking means applied to the upper surface of the cooking plate. Such further marking means may comprise high-temperature-withstanding enamel, paint or lacquer which may be of printed form and may be applied as an outline to the at least one heating zone and/or as a pattern over the at least one heating zone.

Alternatively, the further marking means may comprise one or more scribed, etched or grooved regions of the upper surface of the cooking plate.

The temperature-responsive device may be arranged substantially in contact with the lower surface of the cooking plate at the predetermined region.

The temperature-responsive device may be of capillary, thermocouple or electrical resistance form. When of electrical resistance form, it may comprise a film-form material, such as platinum, whose electrical resistance changes as a function of temperature.

The temperature-responsive device may be electrically connected to control circuitry adapted to control energising of the at least one heating element from a power supply whereby a desired temperature may be provided for the cooking utensil.

The predetermined region of the heating zone overlying the temperature-responsive device may be substantially screened from direct thermal radiation from the at least one electric heating element, such as by means of thermal insulation material which may be arranged in contact with the lower surface of the cooking plate and enclosing the temperature-responsive device.

A further temperature-responsive device may be provided in the at least one electric heater, adapted to monitor temperature of the cooking plate.

By means of the present invention, the exact location, within the heating zone, of the predetermined region of the cooking plate under which the temperature-responsive device is provided, is clearly visually identified. A user can therefore readily position a cooking utensil of any size on the upper surface of the cooking plate such that the utensil covers such predetermined region and such that accurate monitoring of the temperature of the cooking utensil is guaranteed.

For a better understanding of the present invention and to show more clearly how it may be carried into effect, reference will now be made, by way of example, to the accompanying drawings in which:

DESCRIPTION OF PREFERRED EMBODIMENTS

Figure 1:
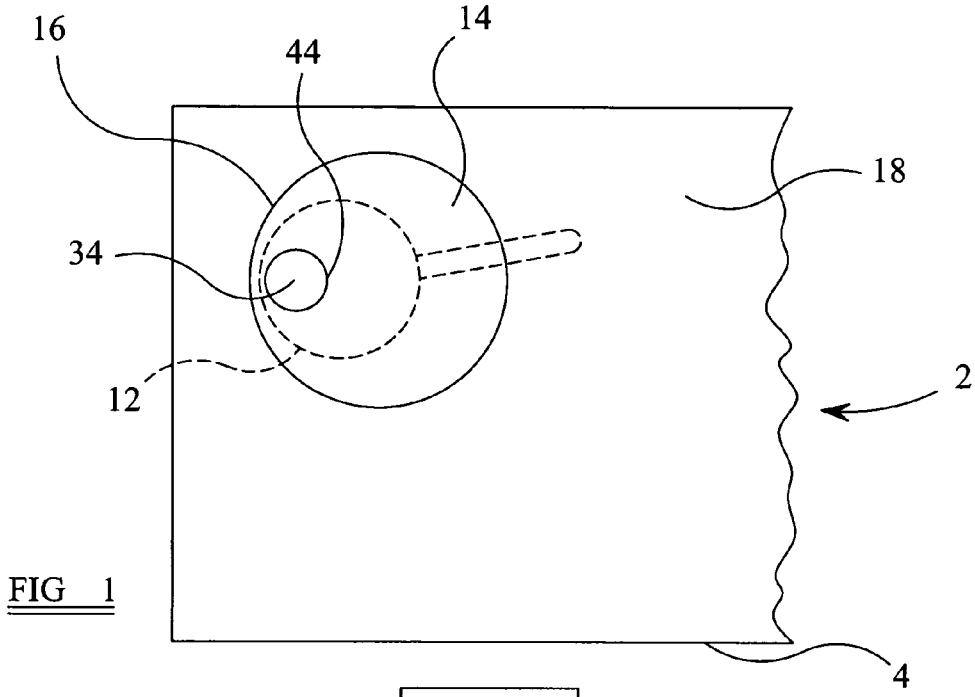
FIG. 1 is a plan view of an embodiment of an electric heating assembly according to the present invention.
Figure 2:
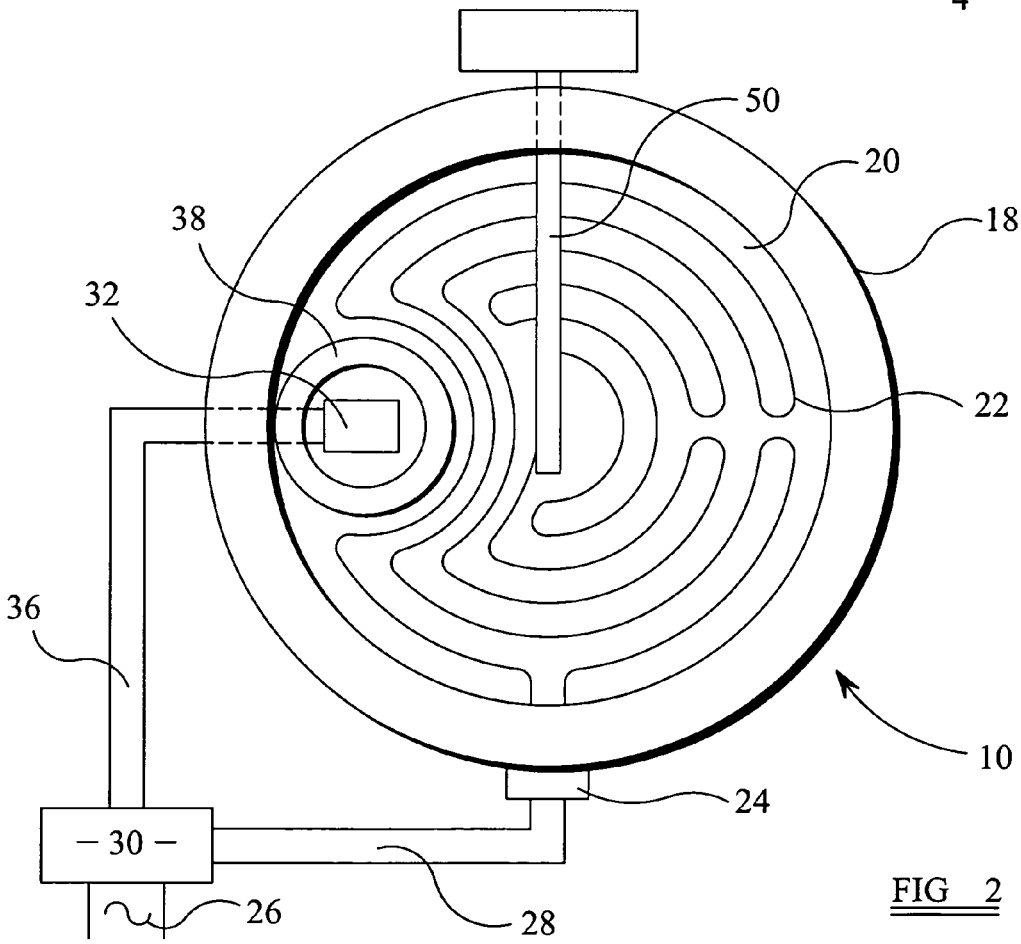
FIG. 2 is a plan view of an embodiment of an electric heater for use in the electric heating assembly of FIG. 1.

An electric heating assembly 2 comprises a glass-ceramic cooking plate 4 having a lower surface 6 and an upper surface 8. An electric heater 10 is supported in contact with the lower surface 6 of the cooking plate 4. The upper surface 8 of the cooking plate 4 is adapted to receive a cooking utensil 12, such as a pan, on a heating zone 14 of the cooking plate 4 overlying the heater 10. The heating zone 14 is suitably identified in known manner by marking means 16 on the upper surface 8 of the cooking plate 4. Such marking means 16 suitably comprises high-temperature-withstanding enamel, paint or lacquer, which may be applied in printed form and suitably as an outline to the heating zone 14 and/or as a pattern on the upper surface 8 of the cooking plate 4 at the heating zone 14. Alternatively, the marking means 16 could comprise one or more scribed, etched or grooved regions of the upper surface 8 of the cooking plate 4 at the heating zone 14.

The electric heater 10 comprises a dish-like support 18, such as of metal, containing a base layer 20 of thermal and electrical insulation material, such as microporous thermal and electrical insulation material. At least one electric heating element 22 is supported relative to the base layer 20. The heating element or elements 22 may comprise any of the well known forms of heating element, such as metal ribbon, wire, foil or lamp forms, or combinations thereof. A terminal block 24 is provided at the edge of the heater 10 and connected to the heating element or elements 22. The heating element or elements 22 is or are electrically connected to a power supply 26 for energising, by way of lead wires 28 and an electronic control circuit 30.

A temperature-responsive device 32 is arranged substantially in contact with the lower surface 6 of the cooking plate 4 and is adapted to monitor temperature of the cooking utensil 12 through the cooking plate 4 at a predetermined small region 34 of the heating zone 14 which is proximate an edge of the heating zone 14. The temperature-responsive device 32 is of known form, such as capillary, thermocouple or electrical resistance form. When of electrical resistance form, the temperature-responsive device 32 suitably comprises a film of a material, such as platinum, whose electrical resistance changes as a function of temperature. When of capillary form, the temperature-responsive device 32 suitably comprises a capsule containing a fluid which expands as a function of temperature. The temperature-responsive device 32 is electrically connected to the electronic control circuit 30 by way of lead wires 36.

The predetermined region 34 of the heating zone 14 under which the temperature-responsive device 32 is arranged, is preferably screened from direct thermal radiation from the heating element or elements 22. This is suitably achieved by providing a block 38 of thermal insulation material in contact with the lower surface 6 of the cooking plate 4 and enclosing the temperature-responsive device 32.

Figure 3:
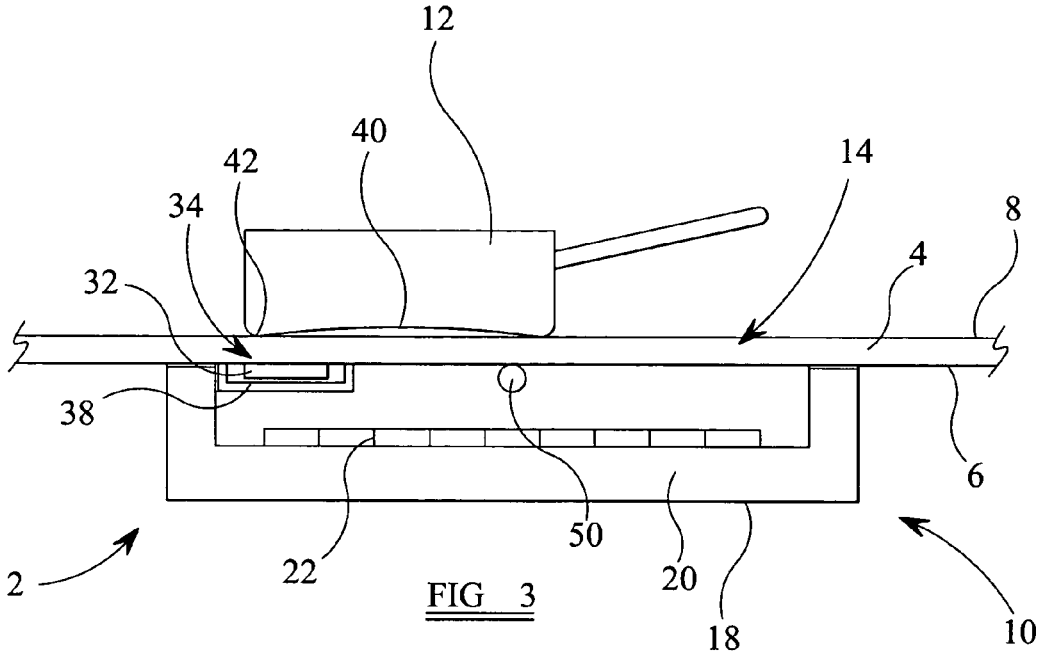
FIG. 3 is a cross-sectional view of the electric heating assembly of FIG. 1.

Cooking utensils, such as the cooking utensil 12, are commonly formed with a concave base 40. This means that an edge region 42 of the base 40 makes good contact with the upper surface 8 of the cooking plate 4. It is this edge region 42 that must be arranged to overlie the temperature-responsive device 32 at the predetermined region 34 of the heating zone 14 if accurate monitoring of the temperature of the cooking utensil 12 is to be obtained. When the cooking utensil 12 is large, such that it substantially fully covers the heating zone 14, there is no problem, since provided the cooking utensil 12 is centered on the heating zone 14, the edge region of the base of the cooking utensil will automatically overlie the temperature-responsive device 32. However, if as shown in FIGS. 1 and 3, a small cooking utensil 12 is provided, then even if this were to be centered on the heating zone 14, the edge region 42 of the base 40 of the utensil may not even partly cover the predetermined region 34 of the heating zone 14 under which the temperature-responsive device 32 is provided. As a result, the temperature-responsive device 32 would not then monitor the temperature of the small cooking utensil 12.

The temperature-responsive device 32 is invisible through the cooking plate so that its position is unknown to a user of the heating assembly.

Figure 4A:
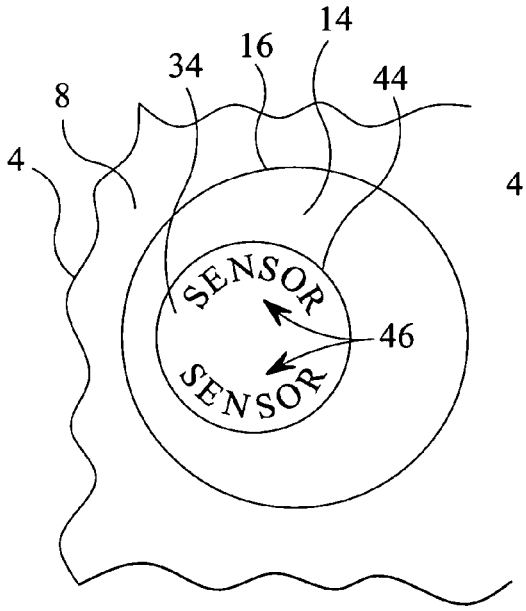
FIGS. 4A and 4B are plan views of a predetermined region of part of the upper surface of the cooking plate of the assembly of FIG. 1, provided with alternative visual identification means.
Figure 4B:
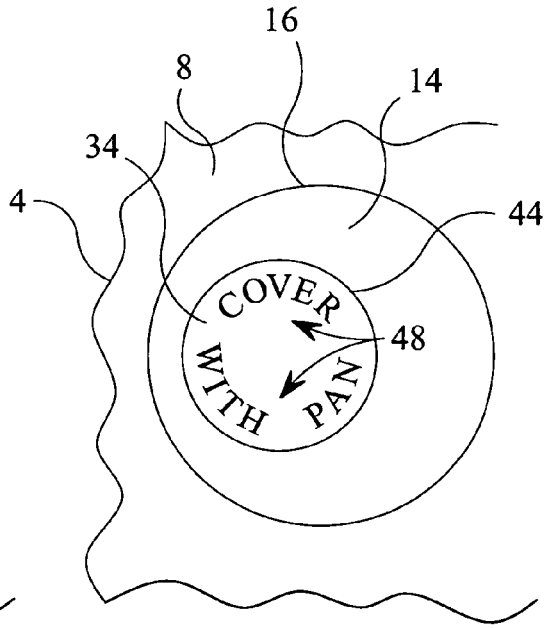

This problem is overcome in the present invention by providing visual identification means 44 on the upper surface 8 of the cooking plate 4, denoting the location of the predetermined region 34 of the heating zone 14 of the cooking plate 4 under which the temperature-responsive device 32 is provided. The visual identification means 44 suitably comprises marking means applied to the upper surface 8 of the cooking plate 4 and suitably comprising high-temperature-withstanding enamel, paint or lacquer, which may be of printed form and applied as an outline to the predetermined region 34. It may additionally or alternatively be applied as a pattern on the predetermined region 34 and/or may include one or more words and/or symbols and/or indicia to assist a user of the assembly in correctly positioning the cooking utensil 12 on the cooking plate 4. For example, as shown in FIG. 4A, the word 'SENSOR' 46 is provided on the predetermined region 34 of the upper surface 8 of the cooking plate 4. As shown in FIG. 4B, an instruction 'COVER WITH PAN' 48 is provided on the predetermined region 34 of the upper surface 8 of the cooking plate 4.

The location of the temperature-responsive device 32 is therefore readily-identified by a user of the heating assembly and the temperature of a cooking utensil 12 of any size can be readily and accurately monitored by simply maneuvering the cooking utensil 12 on the upper surface 8 of the cooking plate 4 such that at least the edge of the cooking utensil 12 covers the predetermined region 34 of the cooking plate 4 marked by the visual identification means 44, 46, 48.

Instead of the visual identification means 44, 46, 48 comprising an enamel, paint or lacquer, it could comprise one or more scribed, etched or grooved regions of the upper surface 8 of the cooking plate 4 provided at the predetermined region 34.

A further temperature-responsive device 50 can be provided in the heater 10 and adapted to operate in known manner to monitor the temperature of the cooking plate 4.

I claim:

1. An electric heating assembly comprising:

a cooking plate having an upper surface and a lower surface, the upper surface being provided with marking means identifying a heating zone on the upper surface of the cooking plate for receiving a cooking plate thereon;

an electric heater incorporating an electric heating element, the heater being supported beneath the lower surface of the cooking plate and adapted to heat a cooking utensil within the heating zone on the upper surface of the cooking plate;

a temperature-responsive device provided within the heater and screened from direct thermal radiation from the heating element whereby the temperature-responsive device is adapted to monitor temperature of the cooking utensil through the cooking plate solely within a predetermined region which is of substantially lesser extent than the heating zone and is confined to an edge area thereof; and marking means provided on the upper surface of the cooking plate and identifying the predetermined region, whereby the user is able to use the temperature-responsive device to determine the temperature of the cooking utensil irrespective of the size thereof.

2. The electric heating assembly of claim 1, wherein the cooking plate comprises glass-ceramic material.

3. The electric heating assembly of claim 1, wherein the marking means comprises material selected from high-temperature-withstanding enamel, paint and lacquer.

4. The electric heating assembly of claim 3, wherein the marking material is printed on the upper surface of the cooking plate.

5. The electric heating assembly of claim 3, wherein the marking material is applied as an outline to the predetermined region.

6. The electric heating assembly of claim 3, wherein the marking material is applied as a pattern on the predetermined region.

7. The electric heating assembly of claim 3, wherein the marking material is applied in the form selected from at least one word, at least one symbol, and at least one indicia.

8. The electric heating assembly of claim 1, wherein the marking means is applied by means selected from scribing, etching and grooving regions of the upper surface of the cooking plate.

9. The electric heating assembly of claim 1, wherein the further marking means comprises material selected from high-temperature-withstanding enamel, paint and lacquer.

10. The electric heating assembly of claim 9, wherein the further marking material is printed on the upper surface of the cooking plate.

11. The electric heating assembly of claim 9, wherein the further marking material is applied as an outline to the heating zone.

12. The electric heating assembly of claim 9, wherein the further marking material is applied as a pattern to the heating zone.

13. The electric heating assembly of claim 9, wherein the further marking material is applied in the form selected from at least one word, at least one symbol, and at least one indicia.

14. The electric heating assembly of claim 1, wherein the further marking means is applied by means selected from scribing, etching and grooving the upper surface of the cooking plate.

15. The electric heating assembly of claim 1, wherein the temperature-responsive device is arranged substantially in contact with the lower surface of the cooking plate at the predetermined region.

16. The electric heating assembly of claim 15, wherein the temperature-responsive device selected from capillary, thermocouple and electrical resistance form.

17. The electric heating assembly of claim 16, wherein the temperature-responsive device comprise a film-form material whose electrical resistance changes as a function of temperature.

18. The electric heating assembly of claim 17, wherein the film-form material comprises platinum.

19. The electric heating assembly of claim 1, wherein the temperature-responsive device is electrically connected to control circuitry adapted to control energising of the at least one heating element from a power supply whereby a desired temperature is provided for the cooking utensil.

20. The electric heating assembly of claim 1, wherein the screening means comprises thermal insulation material.

21. The electric heating assembly of claim 20, wherein the thermal insulation material is arranged in contact with the lower surface of the cooking plate and encloses the temperature-responsive device.

22. The electric heating assembly of claim 1, wherein a further temperature-responsive device is provided in the at least one electric heater, adapted to monitor temperature of the cooking plate.

* * * * *